United States Patent [19]

Nagumo

[11] 4,254,621

[45] Mar. 10, 1981

[54] HEAT-INSULATING LAYER TO PREVENT TEMPERATURE DROP OF COMBUSTION GAS IN INTERNAL COMBUSTION ENGINE

[75] Inventor: Shinichi Nagumo, Yokohama, Japan

[73] Assignee: Nissan Motor Company, Limited, Yokohama, Japan

[21] Appl. No.: 17,008

[22] Filed: Mar. 2, 1979

[30] Foreign Application Priority Data

Mar. 27, 1978 [JP] Japan ..... 53/38108

[51] Int. Cl.[3] ..... B22D 19/08

[52] U.S. Cl. ..... 60/282; 123/193 H; 123/193 P; 123/669; 164/97

[58] Field of Search ..... 60/282, 272; 123/191 A, 123/193 H, 193 CH, 193 CP, 193 P; 164/97, 98, 111

[56] References Cited

U.S. PATENT DOCUMENTS

| | | | |
|---|---|---|---|
| 2,657,961 | 11/1953 | Lassberg | 123/191 A |
| 2,874,429 | 2/1959 | Emter | 164/111 |
| 3,396,777 | 8/1968 | Reding | 164/97 |
| 3,408,995 | 11/1968 | Johnson | 123/191 A |
| 3,718,172 | 2/1973 | Rice | 164/98 |
| 3,756,303 | 9/1973 | Valdo | 164/98 |
| 3,786,795 | 1/1974 | Kaneko | 123/191 A |
| 3,903,951 | 9/1975 | Kaneko | 164/97 |
| 4,074,671 | 2/1978 | Pennila | 123/191 A |
| 4,167,207 | 9/1979 | Rao | 123/193 H |

FOREIGN PATENT DOCUMENTS

| | | | |
|---|---|---|---|
| 888561 | 1/1962 | United Kingdom | 123/193 P |

*Primary Examiner*—Douglas Hart

*Attorney, Agent, or Firm*—Schwartz, Jeffery, Schwaab, Mack, Blumenthal & Koch

[57] ABSTRACT

A heat-insulating layer secured to a cast metal member of an internal combustion engine so as to be exposed to combustion gas in the engine. A porous or intersticed metal body, preferably having a soft structure, is used as a fundamental material of this layer. A surface portion of the porous metal body is impregnated with a ceramic material, and then the metal body is cast-inserted into the metal member such that the molten metal infiltrates into another surface portion of the porous metal body and that the ceramic-impregnated portion is exposed to combustion gas in the engine. This heat-insulating layer is excellent in toughness, durability and bonding strength and can be embodied in a combustion chamber wall, exhaust port wall or a top portion of a piston.

13 Claims, 8 Drawing Figures

HEAT-INSULATING LAYER TO PREVENT TEMPERATURE DROP OF COMBUSTION GAS IN INTERNAL COMBUSTION ENGINE

BACKGROUND OF THE INVENTION

This invention relates to a heat-insulating layer in an internal combustion engine to prevent unwanted lowering of the temperature of combustion gas in combustion chambers or exhaust ports.

Regarding internal combustion engines, particularly automotive engines, the employment of a heat-insulating structure or a heat-insulating coating is effective not only for enhancement of thermal efficiency of the engine but also for decrease in the amount of unburned hydrocarbons (HC) emitted into the atmosphere as an undesirable component of the exhaust gas. Furthermore, when the exhaust system of the engine comprises either a thermal reactor or a catalytic converter to purify the exhaust gas thereby to meet current emission standards, it is desirable to minimize lowering of the exhaust gas temperature before the entrance of the exhaust gas into the reactor or the converter because such a device requires a certain minimum temperature to exhibit its oxidation or conversion ability and exhibits its full ability at considerably high temperatures.

For the purpose of maintaining high exhaust temperatures in internal combustion engines, it has been proposed and sometimes put into practice to cover the wall surfaces of combustion chambers, top face of each piston and/or wall surfaces of exhaust ports with a ceramic material low in heat conductivity, either by attachment of a ceramic plate directly to a surface to be covered or by a flame or plasma spraying technique. However, in practical applications this heat-insulating method involves a serious problem that a ceramic layer formed on a metal surface is liable to crack, break and even separate (at least fragmentarily) from the metal surface due to shocks and vibrations experienced during operation of the engine and a difference in thermal expansion characteristics between the ceramic and the metal. Of course this means an insufficient service life of the heat-insulating layer. As a matter of more seriousness, the service life of a combustion chamber is shortened significantly when fragments of the injured ceramic layer fall into the combustion chamber.

Accordingly there is an earnest desire for a method of producing a heat-insulating layer which can withstand severe environmental conditions in internal combustion engines, that is, a novel type of method for strong, reliable and durable bonding between a metal member and a ceramic material.

SUMMARY OF THE INVENTION

It is an object of the present invention to provide a heat-insulating layer which is firmly and reliably secured to a cast metal member of an internal combustion engine and is highly resistant to shocks, vibrations and thermal stresses produced during operation of the engine.

A heat-insulating layer according to the invention is secured to a cast metal member of an internal combustion engine in such an arrangement that the heat-insulating layer is exposed to a combustion gas produced in the engine and comprises a metal body which has a porous structure. Only a first surface portion of the metal body is impregnated with a heat-insulating ceramic material, which is fired in this portion of the metal body. A second surface portion of the metal body is cast-inserted into the cast metal member such that the metal of the cast metal member infiltrates into at least a part of the second surface portion and that the ceramic-impregnated surface portion is exposed to the combustion gas in the engine.

The aforementioned metal body having a "porous structure" includes a metal body having a multiplicity of interstices (not literally "pores" ).

It is preferable that the porous (or intersticed) metal body has a structure more yielding to compressional and tensional forces than the cast structure of the metal member.

The ceramic-impregnated portion may adjoin the second surface portion inserted into the cast metal member. Alternatively, the ceramic-impregnated portion may entirely be distant from the second surface portion such that the porous structure of the metal body remains unchanged in an intermediate portion interposed between the first and second portions.

Optionally, the outer surface of the ceramic-impregnated portion may be coated with either a protective metal layer or a heat-insulating ceramic layer.

A heat-insulating layer according to the invention can be embodied in a combustion chamber wall, exhaust port wall or a top portion of a piston in the engine.

DESCRIPTION OF THE PREFERRED EMBODIMENTS

Figure 1:
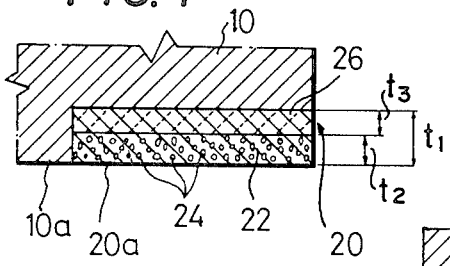
FIG. 1 is a schematic and sectional view of a heat-insulating layer according to the invention inserted into a cast metal member to constitute a surface region of the cast metal member.

In FIG. 1, reference numeral 10 indicates a cast metal member such as a cylinder head constituting part of an engine block of an internal combustion engine. A platy block 20 having a thickness of $t_1$, which is a heat-insulating layer according to the invention, is embeded in a surface region of the cast member 10 such that an outer surface 20*a* of this layer 20 is exposed to combustion gas when the engine comprising the cast member 10 is put into operation. Originally, the platy block 20 is of a metal such as a nickel-base corrosion resistant alloy and has a porous or intersticed structure over its entire thickness $t_1$. It is preferable that the porous metal block has a structure more yielding to compressional and tensional forces than the cast structure of the metal member 10. (Such a structure of the porous metal block is herein called "soft structure" for the sake of convenience.) However, in the illustrated state, i.e. when finished as a heat-insulating layer according to the invention, an exterior portion 22 of this metal block 20 is impregnated with a ceramic material 24, which was fired in the porous matrix of this block 20, such that the resultant ceramic-impregnated (accordingly heat-insulating) layer 22 provides the outer surface 20*a* of the block 20. The remaining interior portion 26 of the block 20 is essentially free of the ceramic 24 and is entirely embedded in the cast member 10.

The embedment of the platy block 20 is accomplished at the stage of forming the engine block member 10 by casting. In advance of the casting operation, the exterior portion 22 of the porous metal block (20) is impregnated with the ceramic 24 (or a raw material for the ceramic 24) by a wet process, followed by firing of the partly ceramic-impregnated block to fix the ceramic 24 dispersed in the exterior portion 22. In most cases, the thickness $t_2$ of the ceramic-impregnated portion 22 is nearly equal to, or somewhat larger than the thickness $t_3$ of the remaining portion 26. The thus prepared (partly porous and partly ceramic-impregnated) platy block 20 is employed as an insert at casting of the engine block member 10. The casting is carried out with the partly ceramic-impregnated block 20 placed in a prescribed position in the mold so that the block 20 may occupy a prescribed surface portion of the product to serve as a thermal barrier between a combustion gas produced in the engine and the principal portion of the cast metal member 10 which is a good heat conductor. In this casting operation, there occurs infiltration of the molten metal into the porous metal structure of the interior portion 26 of the inserted block 20. Upon solidification of the molten metal poured into the mold, therefore, the interior portion 26 of the block or heat-insulating layer 20 is firmly and tightly bonded to the cast metal member 10. In the cast-inserted state, the interior portion 26 of the block or heat-insulating layer 20 according to the invention serves not only as a support for the ceramic-impregnated portion 22 but also as a bridging layer between the cast metal member 10 and the ceramic-impregnated layer 22. It is permissible that the ceramic-impregnated layer 22 partly protrudes or somewhat dents from the surface 10*a* of the cast metal member 10. Also it is permissible that the impregnation of the exterior portion 22 of the block 20 with the ceramic 24 is performed so as to leave a certain degree of porosity to the resultant ceramic-impregnated layer 22.

Essentially, the metal block 20 having a porous or intersticed structure may be a porously sintered body obtained either by a powder sintering technique or a fiber sintering technique, a sponge metal or a mat-like body consisting of densely and irregularly intertangled fine metal wire or filament. The lastly mentioned form is particularly favorable because of its sufficiently soft structure.

In an internal combustion engine, there is no possibility that the heat-insulating layer 20 as a whole separates from the cast metal member 10 or the ceramic-impregnated layer 22 separates from the entirely metallic layer 26 since the heat-insulating layer 20 is cast-inserted into the member 10 and the two layers 22, 26 are originally two continuous and inseparable portions of a single metal body (20). The ceramic 24 in the exterior portion 22 of the heat-insulating layer 20 takes the form of fine particles dispersed in and fixed (by firing) to the porous metal matrix of the exterior portion 22 of the heat-insulating layer 20 and, hence, hardly separates from the metal matrix even when the heat-insulating layer 20, particularly its ceramic-impregnated portion 22, is subjected to thermal and mechanical stresses during operation of the engine. Even when a very small portion of the ceramic particles 24 separate from the metal matrix and the separated particles fall into a combustion chamber of the engine, a detrimental effect of such particles on the engine will be far less material in comparison with detrimental effects of relatively large flakes separated from a conventional ceramic coating for the similar heat-insulating purpose. When the porous metal block (20) has a soft structure as is preferred herein, some strains possibly produced in the ceramic-impregnated portion 22 by thermal stresses during operation of the engine will be absorbed in the soft metal structure.

Preparing the ceramic-impregnated layer 22 so as to retain certain degree of porosity is effective for reducing the emission of HC because a portion of HC is caught in the pores of this layer 22 and readily undergoes afterburning.

Usually it is appropriate that the total thickness $t_1$ of the heat-insulating layer 20 of FIG. 1 is in the range from about 6 mm to about 8 mm and the thickness $t_3$ of the interior portion 26, where the cast metal has infiltrated into the porous structure of the original metal block (20), is made to range from about 2 mm to about 3 mm. Preferably the thickness $t_2$ of the ceramic-impregnated portion 22 is made to range from about 3 mm to about 4 mm.

Figure 2:
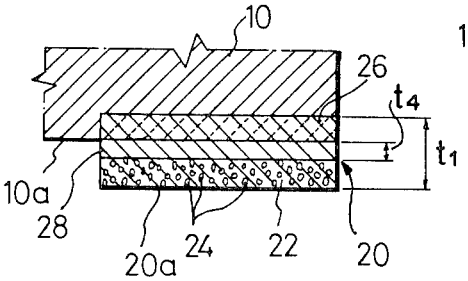

However, as shown in FIG. 2, the thickness $t_1$ of the original metal block (20) and the manner of insertion of the partly ceramic-insulated block in the cast member 10 may be modified such that the finished heat-insulating layer 20 has a solely metallic and porous portion 28, as an intermediate portion between the ceramic-impregnated portion 22 and the interior portion 26 cast-inserted in the cast metal member 10, where the porous structure of the original metal block (20) remains unchanged, meaning that the molten metal has not infiltrated into this portion 28 during casting operation. Since the porous intermediate layer 28 is higher in strain-absorbing ability than the interior portion 26 impregnated with a cast metal, strains produced in the ceramic-impregnated portion 24, sometimes also in the interior portion 26, during operation of the engine are almost thoroughly absorbed in the porous portion 28. Accordingly the ceramic-impregnated portion 24 of the heat-insulating layer 20 of FIG. 2 is still less liable to suffer injuries such as cracking than the counterpart in FIG. 1. A thickness $t_4$ of about 3 to 4 mm is sufficient to the porous intermediate layer 28, so that the total thickness $t_1$ of the heat-insulating layer 20 of FIG. 2 will usually range from about 9 mm to about 12 mm. The boundary between the ceramic-impregnated portion 22 and the porous portion 28 may be in a plane outside of the surface 10*a* of the cast member 10.

Figure 3:
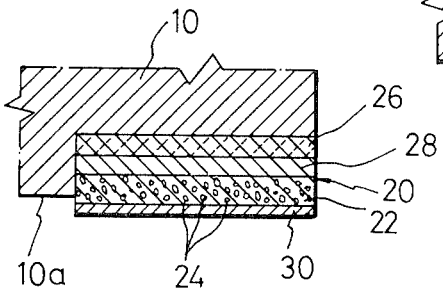

Referring to FIG. 3, a metal coating layer 30 may optionally be formed on the outer surface of the ceramic-impregnated portion 22 of the heat-insulating layer 20. The metal coating 30 is formed before casting of the engine block member 10 together with the semifinished heat-insulating layer by flame or plasma spraying of a metal onto the surface of the ceramic-impregnated portion 22 or by dipping of a surface region of the ceramic-impregnated portion 22 in a molten metal bath. Even when a portion of the ceramic particles 24 separates from the metal matrix of the exterior portion 22, the metal coating 30 prevents actual separation of the ceramic particles 24 from the heat-insulating layer 20.

FIG. 3 shows the addition of the metal coating 30 to the heat-insulating layer 20 of FIG. 2, but of course the same modification can be made also to the embodiment of FIG. 1.

Figure 4:
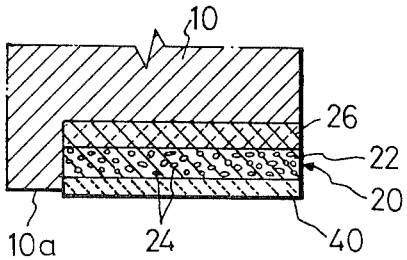
FIGS. 2–5 show four kinds of modifications of the heat-insulating layer of FIG. 1, respectively.
Figure 5:
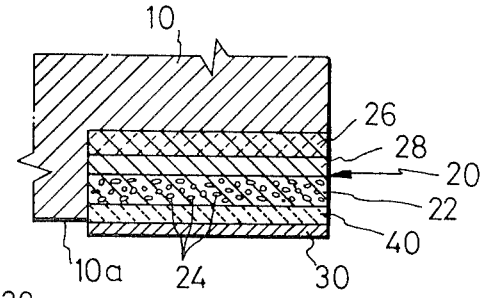

When it is desired to especially enhance the thermal barrier characteristic of a heat-insulating layer 20 according to the invention, an entirely ceramic layer 40 shown in FIG. 4 may be formed on the outer surface of the ceramic-impregnated portion 22. FIG. 4 shows the addition of the ceramic layer 40 to the heat-insulating layer of FIG. 1, but it will be apparent that the ceramic layer 40 can be added in the same manner to the embodiment of FIG. 2, too. Referring to FIG. 5, also it is optional to employ the above described metal coating 30 together with the entirely ceramic layer 40. In this case, too, the metal coating 30 is formed as the outermost portion of the heat-insulating layer 20 as will be apparent from the role of the metal coating 30.

Figure 6:
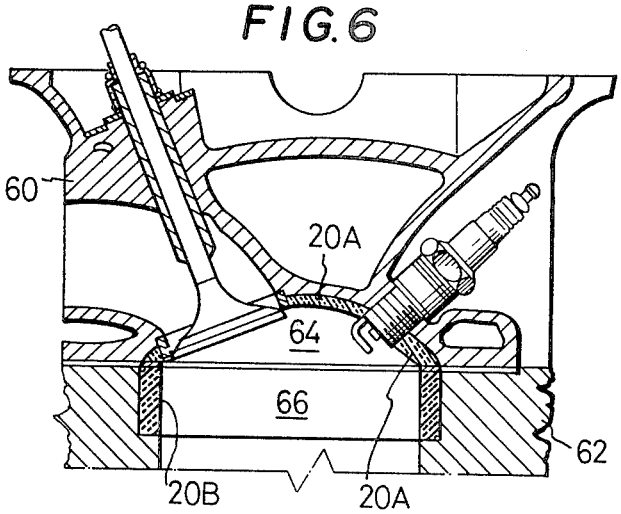
FIG. 6 is a schematic and sectional view of a combustion chamber portion of an internal combustion engine, wherein heat-insulating layers according to the invention are arranged to provide combustion chamber wall surfaces.

FIG. 6 illustrates the application of the invention to a combustion chamber, i.e. an assembly of a cylinder head 60 formed with a dent 64 in its bottom face and a cylinder block 62 formed with a cylinder bore 66. The dent 64 and an upper portion of the bore 66 constitute the combustion chamber. As is usual, both the cylinder head 60 and the cylinder block 62 are formed primarily by casting. The cylinder head 60 comprises a heat-insulating layer 20A, whose construction may be any one of the constructions described with reference to FIGS. 1–5, arranged such that this layer 20A provides the bottom face of the cylinder head 60 in its dented region. The cylinder block 62 comprises a cylindrically shaped heat-insulating layer 20B according to the invention such that the outer surface of this layer 20B serves as an uppermost portion of the cylindrical wall face of the bore 66.

Figure 7:
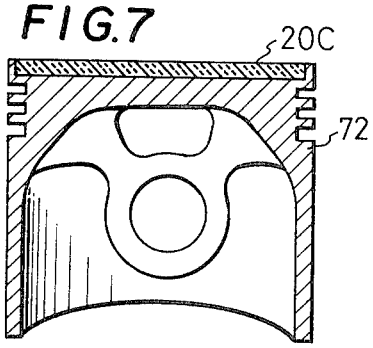
FIG. 7 is a sectional view of a top portion of a piston for an internal combustion engine, wherein a heat-insulating layer according to the invention provides the top face of the piston.

Referring to FIG. 7, a cast-formed piston 72 to be received in an engine cylinder such as the one in FIG. 6 may comprise a disc-shaped heat-insulating layer 20C according to the invention as a top end portion of the piston 72. The construction of this heat-insulating layer 20C, too, may be any one of those described with reference to FIGS. 1–5.

Figure 8:
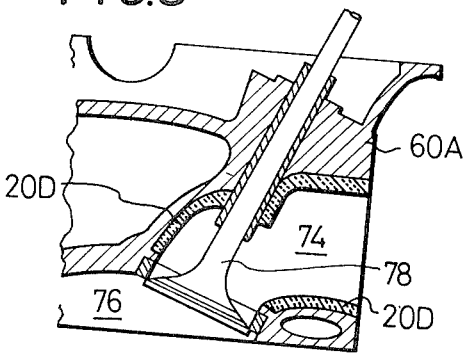
FIG. 8 is a schematic and sectional view of an exhaust port of an internal combustion engine, wherein heat-insulating layers according to the invention are arranged to provide the port wall surfaces.

FIG. 8 shows an exhaust port 74 formed in a cast-formed cylinder head 60A for an internal combustion engine as an exhaust passage connecting a combustion chamber 76 to an exhaust manifold (not shown). Indicated at 78 is a usual exhaust valve. The cylinder head 60A comprises a heat-insulating layer 20D (which may be constituted of several pieces of blocks) according to the invention such that the generally cylindrical wall face of the exhaust port 74 is substantially entirely given by the heat-insulating layer 20D. Also in this case, any one of the constructions of the heat-insulating layer 20 described with reference to FIGS. 1–5 may be employed. Since a major part of the production of a heat-insulating layer according to the invention 20 is completed before casting of the cylinder head 60A which the insertion of the partly ceramic-impregnated block by utilizing a desirably shaped block (20) of a porous metal, there is no difficulty in the application of the heat-insulating layer 20D to the exhaust port 74. Of course, the heat-insulating layer 20D for the exhaust port 74 may be employed in combination with at least one of the heat-insulating layers 20A, 20B, 20C for the combustion chamber and the piston.

As will be understood from the description of the illustrated embodiments, a heat-insulating layer (or layers) according to the invention in an internal combustion engine is highly effective for prevention of unwanted lowering of the exhaust gas temperature either in combustion chambers or in exhaust ports. Therefore, the oxidation of HC and CO in the exhaust gas proceeds during passage of the exhaust gas through the exhaust ports, and the exhaust gas arrives at a thermal reactor or a catalytic converter at temperature high enough to a sufficiently effective function of the reactor or the converter. When the invention is applied to the combustion chambers, it brings about an improvement in the thermal efficiency of the engine as an additional effect.

What is claimed is:

1. A heat-insulating layer secured to a cast metal member of an internal combustion engine in such an arrangement that the heat-insulating layer is exposed to a combustion gas produced in the engine, the heat-insulating layer comprising:

a metal body having a porous structure, only a first surface portion of said metal body being impregnated with a heat-insulating ceramic material which is fired in said surface portion, a second surface portion of said metal body being cast-inserted into said cast metal member such that the metal of said cast metal member infiltrates into at least a part of said second surface portion and that said first surface portion is exposed to said combustion gas in the engine.

2. A heat-insulating layer according to claim 1, wherein said second surface portion adjoins said first surface portion.

3. A heat-insulating layer according to claim 1, wherein said second surface portion is entirely distant from said first surface portion such that an intermediate portion of said metal body interposed between said first and second surface portions retains said porous structure of said metal body.

4. A heat-insulating layer according to claims 2 or 3, further comprising a metal layer coated on an outer surface of said first surface portion.

5. A heat-insulating layer according to claims 2 or 3, further comprising a heat-insulating layer of a ceramic material coated on an outer surface of said first surface portion.

6. A heat-insulating layer according to claim 5, further comprising a metal layer coated on the outer surface of said heat-insulated layer of a ceramic material.

7. A heat-insulating layer according to claim 1, wherein said metal body has a structure more yielding to compressional and tensional forces than the cast structure of said metal member.

8. A heat-insulating layer according to claims 1 or 7, wherein said metal body is a sintered metal body.

9. A heat-insulating layer according to claims 1 or 7, wherein said metal body is of a sponge metal.

10. A heat-insulating layer according to claim 7, wherein said metal body consists of densely intertangled fine metal wire.

11. A heat-insulating layer according to claim 1, wherein said cast metal member is an engine block member, the heat-insulating layer being exposed to a combustion chamber of the engine.

12. A heat-insulating layer according to claim 1, wherein said cast metal member is an engine block member, the heat-insulating layer being exposed to an exhaust port of the engine.

13. A heat-insulating layer according to claim 1, wherein said cast metal member is a piston, the heat-insulating layer being arranged to constitute a top portion of the piston.

* * * * *